US008474218B2

(12) United States Patent
Hodgson

(10) Patent No.: US 8,474,218 B2
(45) Date of Patent: Jul. 2, 2013

(54) MODULAR INTER-LOCKING EXTERIOR WALL SYSTEM

(76) Inventor: Robert Spencer Hodgson, Orinda, CA (US)

( * ) Notice: Subject to any disclaimer, the term of this patent is extended or adjusted under 35 U.S.C. 154(b) by 0 days.

(21) Appl. No.: 13/235,068

(22) Filed: Sep. 16, 2011

(65) Prior Publication Data

US 2012/0066997 A1 Mar. 22, 2012

Related U.S. Application Data

(60) Provisional application No. 61/383,614, filed on Sep. 16, 2010.

(51) Int. Cl.
*E04B 2/00* (2006.01)

(52) U.S. Cl.
USPC ..... 52/779; 52/282.1; 52/283; 52/475.1; 52/778

(58) Field of Classification Search
USPC ..... 52/238.1, 239, 241, 243, 282.1, 283, 52/284, 475.1, 777–779; 256/19, 24; 248/223.41
See application file for complete search history.

(56) References Cited

U.S. PATENT DOCUMENTS 3,106,503 A * 10/1963 Frobisher et al. ..... 156/290
3,304,683 A * 2/1967 Ferreira ..... 52/764
3,729,889 A * 5/1973 Baruzzini ..... 52/264
3,918,686 A * 11/1975 Knott et al. ..... 256/59
4,052,832 A * 10/1977 Jungers et al. ..... 52/779
4,485,597 A * 12/1984 Worrallo ..... 52/479
4,716,692 A * 1/1988 Harper et al. ..... 52/36.6
5,671,913 A * 9/1997 Vesper ..... 256/31
5,896,717 A * 4/1999 Gill ..... 52/586.2
6,253,530 B1 * 7/2001 Price et al. ..... 52/793.1
6,393,791 B1 * 5/2002 Mann ..... 52/478
7,073,301 B1 * 7/2006 Price ..... 52/477
7,669,372 B2 * 3/2010 Schaffer ..... 52/309.7
2006/0113517 A1 * 6/2006 Colantonio et al. ..... 256/24
2010/0096608 A1 * 4/2010 McCarthy et al. ..... 256/19

* cited by examiner

*Primary Examiner* — Brian Glessner
*Assistant Examiner* — Adriana Figueroa
(74) *Attorney, Agent, or Firm* — Brian Beverly; Beeson Skinner Beverly, LLP

(57) ABSTRACT

A modular interlocking exterior wall system comprises one or more laminated panels formed of a paper product core sandwiched between two cementitious skins, two vertical posts having laterally extending flanges which interlock in vertical grooves formed in the sides of the panels, and a top rail having a downwardly opening top groove which receives and reinforces the horizontal top edge of the top panel, wherein bottom portions of the posts are anchored below ground. An optional bottom rail has an upwardly opening groove for receiving and supporting the bottom edge of the bottom panel, and laterally extending flanges of an optional mid rail are received in top and bottom grooves, respectively, of bottom and top panels to interlock and reinforce the panels.

12 Claims, 7 Drawing Sheets

MODULAR INTER-LOCKING EXTERIOR WALL SYSTEM

CROSS-REFERENCE TO RELATED APPLICATIONS

This application claims the benefit of U.S. Provisional Application No. 61/383,614 filed Sep. 16, 2010.

BACKGROUND

1. Field of the Invention

This invention relates to exterior wall systems, and particularly to exterior wall barriers constructed from non-wood products including laminated panels having cementitious-type outer layers and a treated paper product core.

2. Prior Art

People seek a "green," durable, visual, audio, personal privacy, safety and fire barrier at the perimeter of their real property, due to high density population in a restricted area, movement or noise from outside the perimeter and threat from fire, crime or trespass upon their real property. Current exterior barriers, such as fencing, do not simultaneously provide solutions for acoustical, visual, audio, privacy and safety concerns, provide a fire barrier, or provide a 'green' solution to diminishing forest resources. Additionally, conventional fencing is prone to pest damage and deterioration due to exposure to exterior such as moisture, thus requiring continual maintenance to maintain functional and aesthetic value. Moreover, there is no exterior wall product in the prior art which facilitates adding accessories to the basic product. The instant invention addresses all these concerns in one system, utilizing ecologically sustainable, durable, nonflammable, sound-deflecting and absorbing, pest and exposure resistant, recycled and/or recyclable materials.

DETAILED DESCRIPTION OF THE INVENTION

Figure 1:
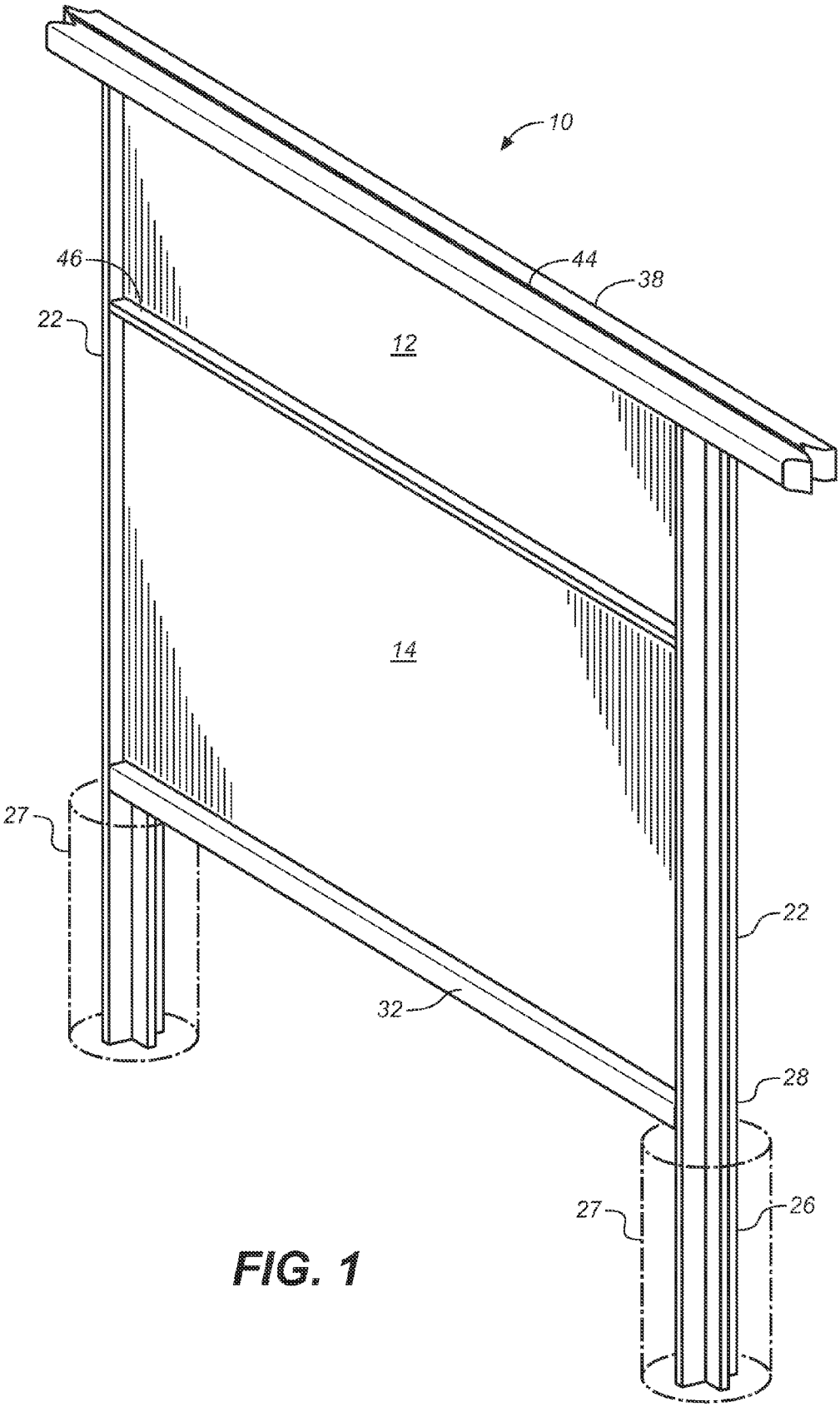
FIG. 1 is an upper perspective view of a modular interlocking wall system according to the invention.

A modular inter-locking exterior wall system according to the invention, indicated generally at 10 in FIG. 1, comprises top and base panels 12, 14. With additional reference to FIG. 2, each panel 12, 14 is a sandwich-like composite of a treated paper product core 16 bonded on two sides with skins 18 of a cementitious-type board. The core is fabricated to form a series of triangular cells 19 similar to the cross-section of corrugated board, and is commonly referred to as having a honeycomb-like construction, or simply as a honeycomb. See FIG. 2A. The paper core material may be treated with phenolic resins to increase resistance to moisture and pests. The composite forms a light-weight, strong, rigid panel with excellent acoustic and thermal insulating properties. Optionally, fire retardant may be added to the core material to augment the fire resistant properties of the surrounding skins 18 and increase the fire retarding properties of the composite panel. Suitable core material for the panels is available from Tricel Honeycomb Corporation, located in Gurnee, Ill. A suitable cementitious-type of material for the panel skins is Greene-board™ wall paneling available from Southern Cross Building Products, 3461 High Ridge Road, Boynton Beach, Fla. 33426. A suitable environmentally friendly, non-toxic adhesive is Simalfa® water-based adhesive available from Alfa Adhesives, Inc., 15 Lincoln Street, Hawthorne, N.J. 07506. A suitable environmentally friendly stucco covering for the panels is Parex® stucco available from Parex USA, 4125 E. LaPalma Ave., Suite 250, Anaheim, Calif. 92807.

Figure 2:
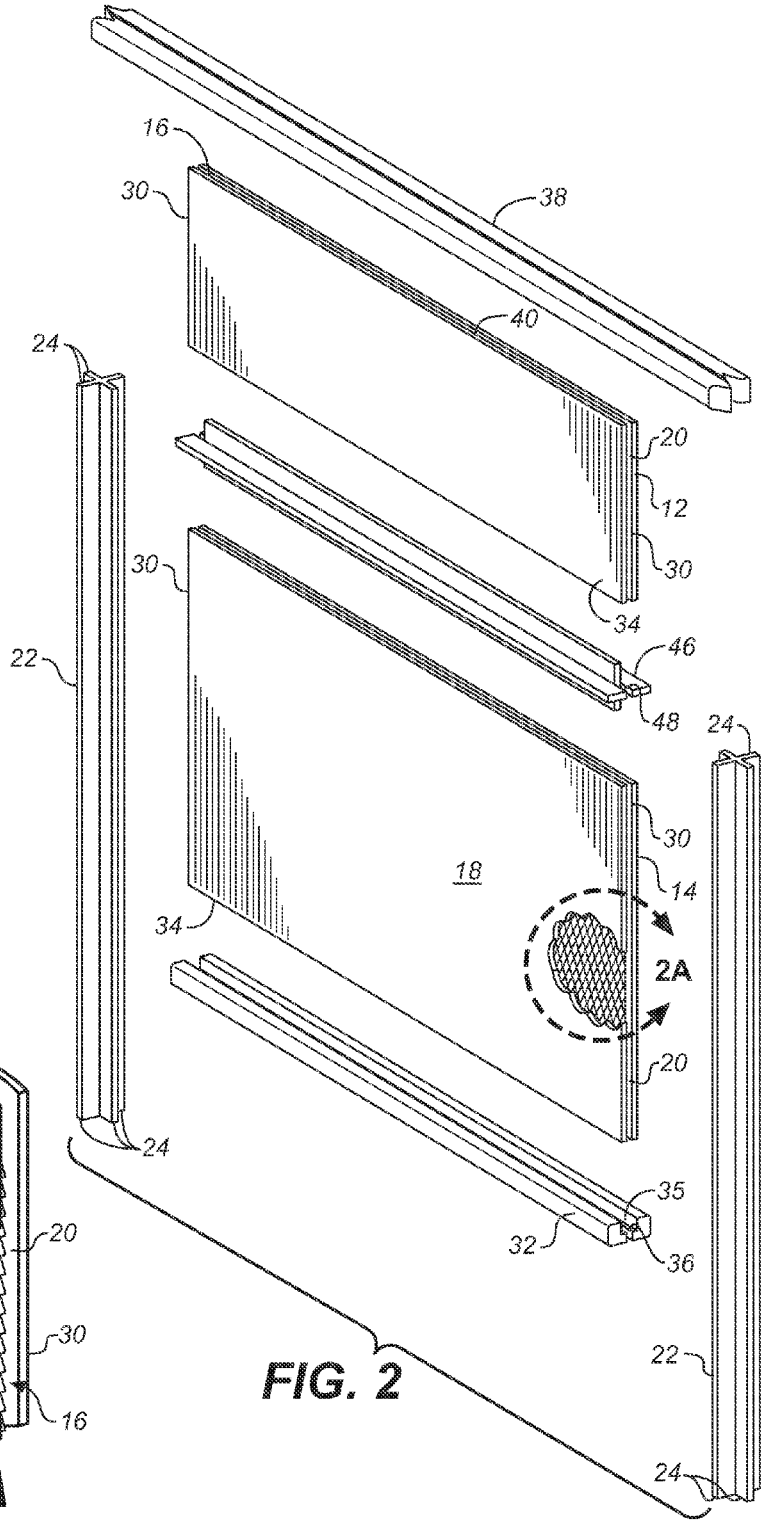
FIG. 2 is an exploded perspective view of the nodular interlocking wall system shown in FIG. 1.
Figure 2A:
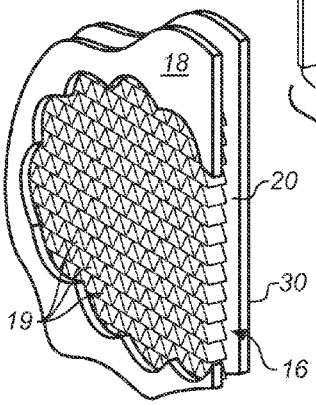
FIG. 2A is a close-up perspective view of a portion of the wall of the modular interlocking wall system shown in FIG. 2.

The sandwiched composite panel core 16 is slightly and uniformly smaller in length and width than the length and width of the cementitious skins 18, thereby creating a groove 20 of uniform depth around the perimeters of each of the panels 12, 14 as shown in FIG. 2.

Figure 3:
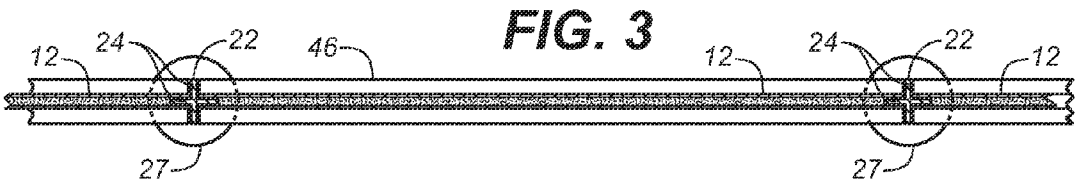
FIG. 3 is a sectional view of the modular interlocking wall system shown in FIG. 4 taken along lines 3-3 thereof.
Figure 5:
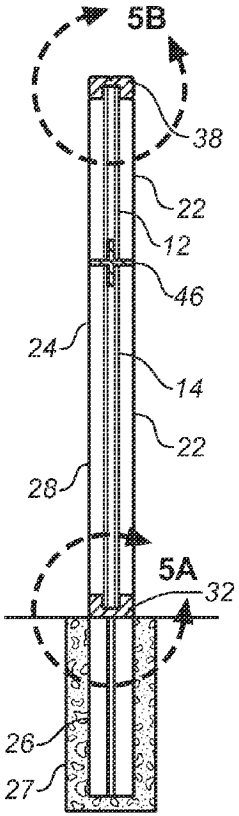
FIG. 5 is a sectional view of the modular interlocking wall system shown in FIG. 4 taken along lines 5-5 thereof.

The vertical support posts 22 are composed of a shaped, extruded, drawn, welded or molded material having perpendicularly extending flanges 24, as seen in FIGS. 2, 3, and 5, of uniform dimension configured to form an "X" shaped cross-section (see FIG. 5). The vertical support post 22 is designed to have a portion 26 anchored in cement 27 in the ground, whereby the remainder 28 of the vertical support post 22 stands above ground. See also FIG. 1. The vertical grooves 20 on the ends 30 of the panels 12, 14 are each designed to accept the flanges 24, allowing the panels 12, 14 to be supported vertically by the support posts 22. It will be appreciated by those of skill in the art that posts 22 may be constructed with flanges that form a "T" shaped cross-section, such as when the post will be used to support one end of a wall. See, e.g., FIGS. 6 and 7.

A base rail support 32 comprises a shaped, extruded, welded or molded material designed to horizontally support the bottom horizontal side 34 of the panels 12, 14 at or below ground level. As shown in FIG. 5A, the base rail support 32 includes upwardly opening groove 35, slightly wider than the panel width, allowing either of the panels 12, 14 to slide into and mate with base rail support 32 on the lower horizontal long side 34 of the panels 12, 14. The base rail support 32 has notches 36 at both ends to accept one of the flanges 24 of the vertical support post 22.

The top rail support 38 comprises a shaped, extruded, welded or molded material designed to horizontally cap and support the top horizontal side 40 of either of panels 12, 14.

Like the base rail support 32, the top rail support 38 has a downwardly opening groove 42, slightly wider than the panel width, allowing the top horizontal long side 40 of panels 12, 14 to slide into and mate with the top rail support 38. A top channel 44 runs the length of the top rail support on the top surface, and is intended to enable accessories to be attached to the wall system 10. See FIG. 5B.

The mid rail support 46 may be configured to have an "X" shaped cross-section like vertical support posts 22 or may be a flat bar, but is designed to horizontally support and connect two adjacent panels 12, 14 as a means of increasing the vertical height of the wall assembly. The mid rail support 46 rests on and mates horizontally atop panel 14 and, like the lower base rail support 32, has notches 48 on both ends to accept flanges 24 of posts 22.

Figure 4:
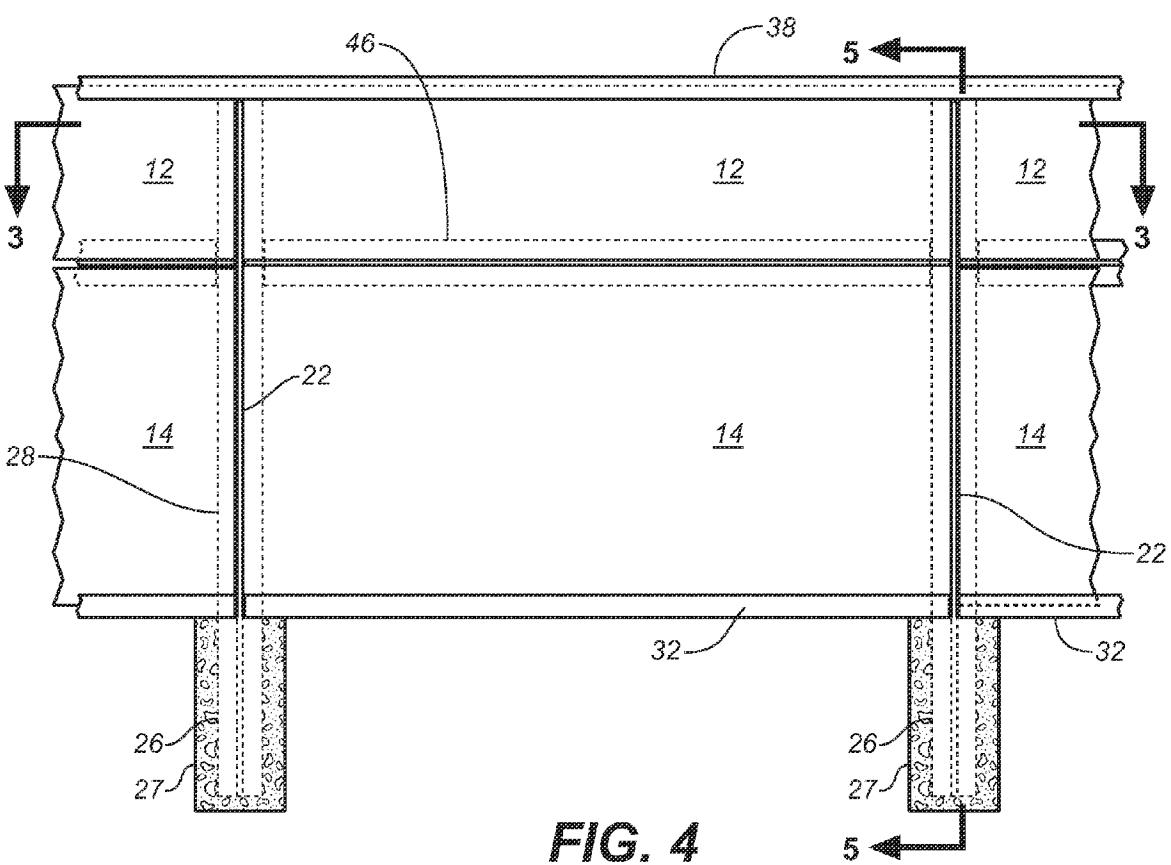
FIG. 4 is a front elevation view of the wall of the modular interlocking wall system shown in FIG. 1.

FIG. 4 shows a side elevation view of an assembled version of the embodiment of the modular interlocking wall system shown in FIGS. 1 and 2. FIG. 3 shows the posts 22 inserted into the side grooves of top panel 12.

FIG. 5 shows the mid rail 46 inserted into the bottom groove of top panel 12 thereby supporting top panel 12 and also inserted into the top groove of bottom panel 14 for rigidifying and securing bottom panel 14.

Figure 5B:
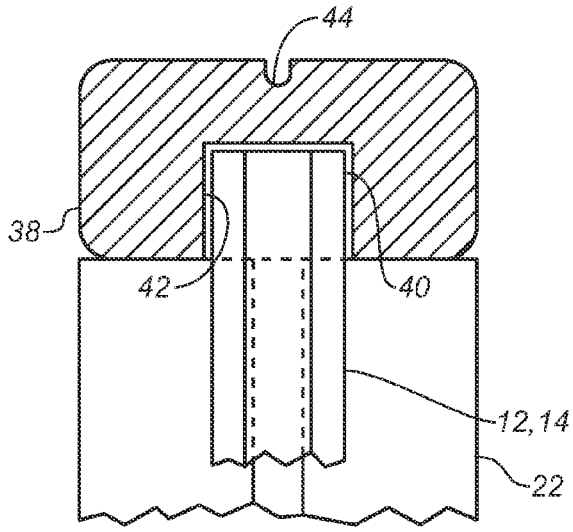
FIG. 5B is a close-up elevation view of a portion of the modular interlocking wall system shown in FIG. 5 showing the bottom of the wall panel and the bottom rail.
Figure 5A:
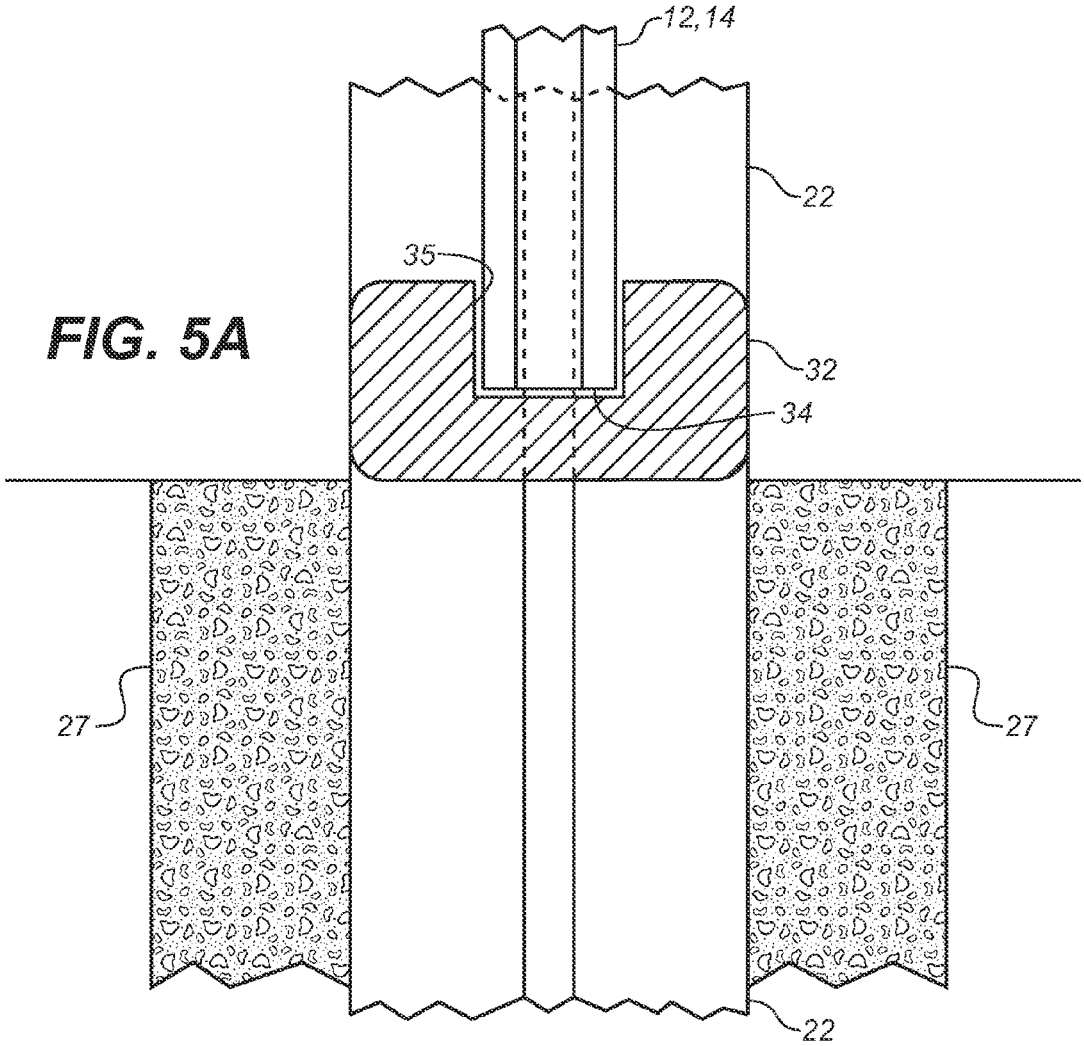
FIG. 5A is a close-up elevation view of a portion of the modular interlocking wall system shown in FIG. 5 showing the bottom of the wall panel and the bottom rail.

FIG. 5A shows bottom rail 32 supporting the bottom side of either of top or bottom panels 12,14 and FIG. 5B shows top rail 38 capping, and reinforcing the top side of either of top or bottom panels 12, 14, as discussed above.

Figure 6:
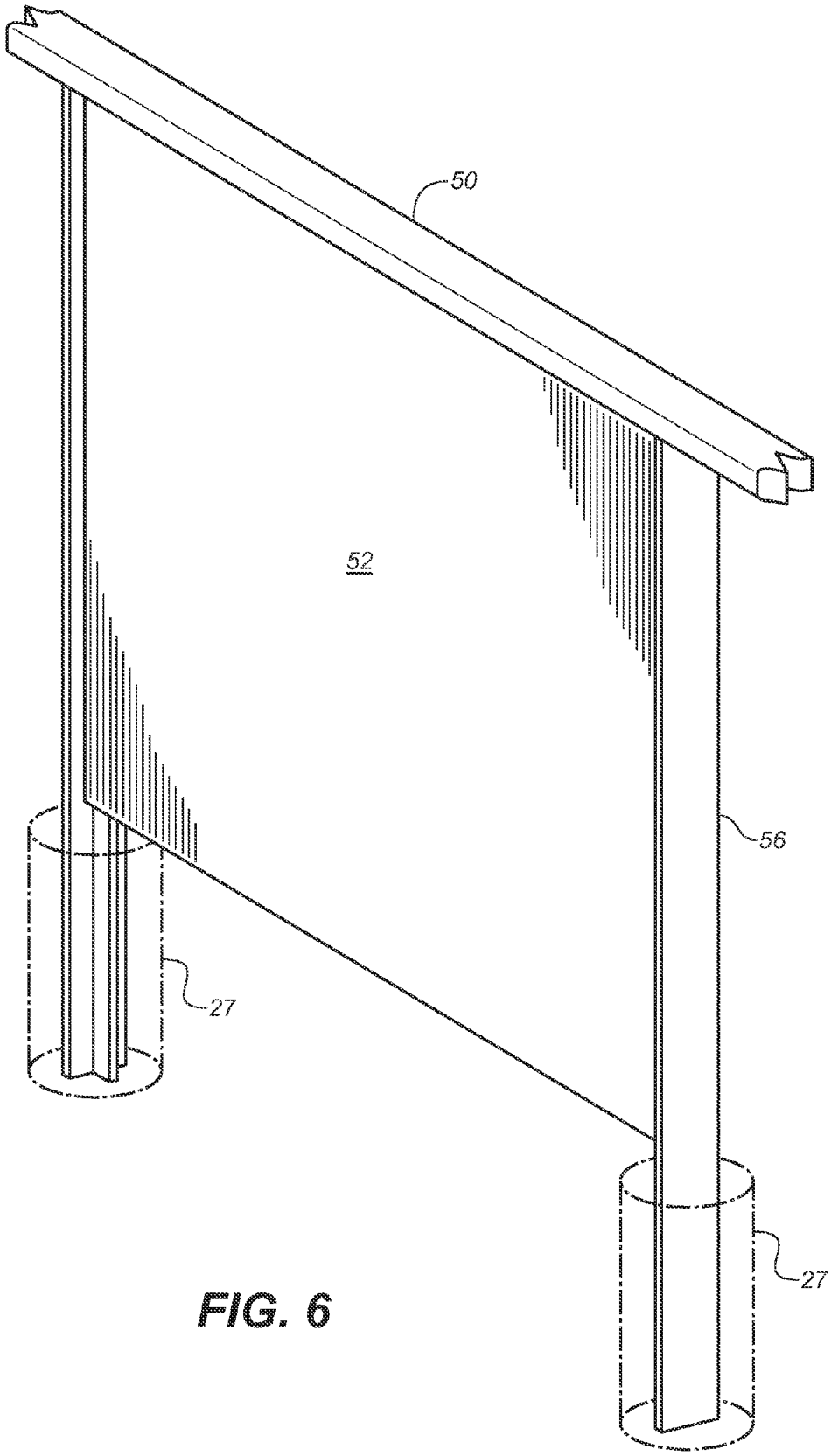
FIG. 6 is an upper perspective view of another embodiment of the invention without a bottom rail.

FIG. 6 shows another embodiment of a modular interlocking wall system according to the invention including a single panel 14, two vertical support posts 56 having a "T" shaped cross-section and a top rail 50.

Figure 7:
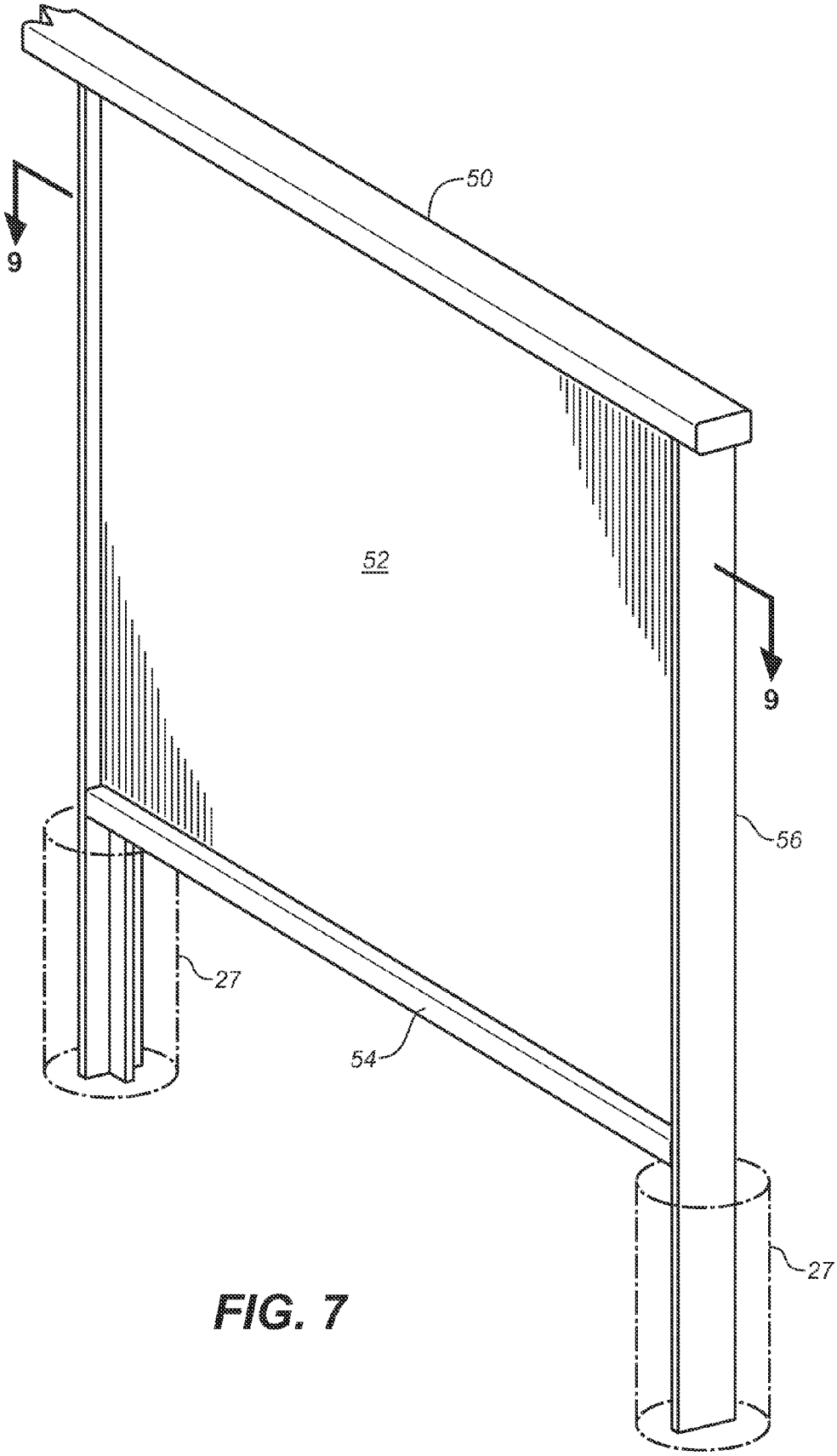
FIG. 7 is an upper perspective view of yet another embodiment of the invention with a bottom rail.

FIG. 7 shows still another embodiment of a modular interlocking wall system according to the invention similar to the embodiment shown in FIG. 6 and including a bottom rail 54.

Figure 8:
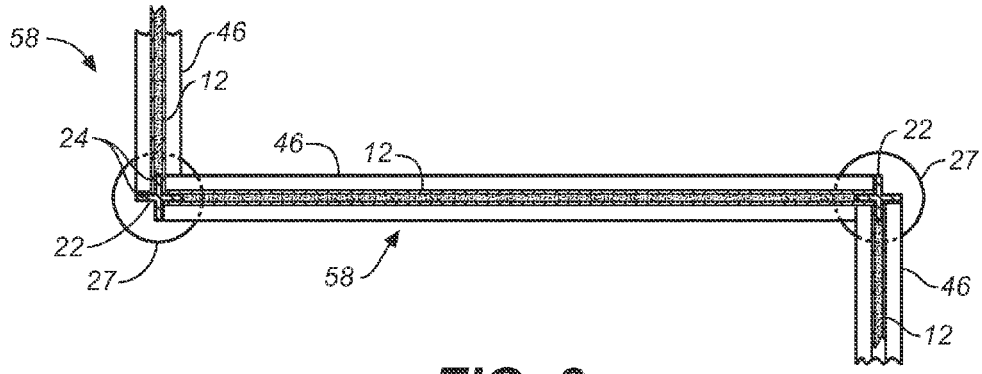
FIG. 8 is a top plan sectional view of a further embodiment of the invention showing wall sections meeting perpendicularly.
Figure 9:
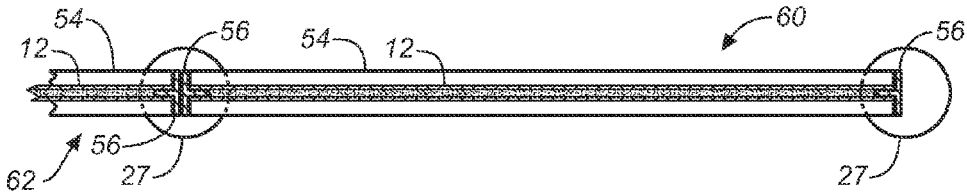
FIG. 9 is a sectional view taken generally along line 9-9 in FIG. 7 of another embodiment of the invention showing one end of a wall terminating in a T-shaped support post.
Figure 10:
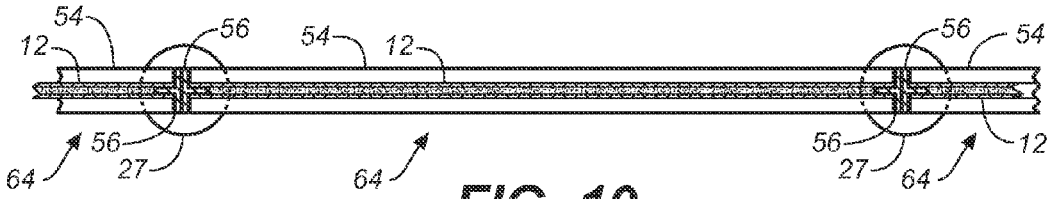
FIG. 10 is a diagrammatic top plan sectional view similar to FIG. 9 of still a further embodiment of the invention showing adjoining wall sections meeting at abutting pairs of T-shaped support posts.

Finally, FIGS. 8-10 show different configurations of a modular inter-locking exterior wall system. FIG. 8 shows a zig-zag configuration in which adjoining wall sections 58 meet perpendicularly at common vertical posts 22 for implementing directional changes. FIG. 9 shows a wall section 60 terminating at a T-shaped post 56 on the right side and two sections 60, 62 meeting at a pair of abutting T-shaped posts 56 on the left side. FIG. 10 shows three wall sections 64 arranged in linear alignment meeting at pairs of T-shaped posts 56.

The invention, without the accessories, comprises at least three interlocking components: (1) the vertically-mounted, vertical support posts 22, (2) one of the panels 12, 14, and (3) the top rail support 1. In alternate embodiments the wall system may include both panels 12, 14, base rail support 32, and mid rail support 46. No mechanical fasteners are necessary. All components can be permanently affixed to one another utilizing exterior grade sealant adhesive (e.g., silicone adhesive). Two vertical support posts 22 are necessary to support one panel 12, 14, one top rail support 1. All exposed surfaces are coated in a base finished coat layer of exterior grade stucco or similar. Collectively the components create an exterior wall system or assembly. Optional additional elements that enhance the invention include drip irrigation, low voltage lighting, mounted flower box, bird feeder, table, seating, water fall, solar panel, and the like.

One advantage of the invention is in its simplicity and the inter-changeability of its component parts. The vertical support post 22 allows the honeycomb composite panels 12, 14 to be mounted at four different points (the four tangs 24 of the X). The notch 20 around the panel's edge allows it to mate in any direction on all four sides. The mid rail support 46 is the same extrusion configuration as the vertical support post 22, and the top and base rail supports 38, 32 are similar with the difference that the top rail support 38 may have a top channel 44 for top-mounted accessories.

This device may be utilized anywhere that there is open space which can be partitioned or where it may be desirable to create a private area. It can be mounted on or into flat ground, a hillside, around a pool, or the front or backside of a building. Where there are height restrictions, the panels 12, 14 have different heights, allowing the device to be erected to several heights as desired by selectively using panel 12 alone, panel 14 alone, or both panels 12, 14. The device has the general appearance of a sturdy concrete stucco wall, yet has the space saving horizontal footprint of a conventional fence, is easy to assemble, and is constructed of environmentally friendly components.

A modular inter-locking exterior wall system provides an exterior panelized wall system providing privacy to real property, with materials that have green-certified content and/or are recyclable. The invention is modular, designed to erect in a similar (but simpler) fashion to conventional fencing with the aesthetic perceptibility of a concrete stucco wall.

It should be understood that the foregoing relates to exemplary embodiments of the invention and that modifications may be made without departing from the spirit and scope of the invention as set forth in the following claims.

I claim:

1. A modular interlocking wall system comprising:

one or more laminar panels, each said panel having a paper product core, two cementitious skins, horizontal top and bottom edges and two vertical side edges, said paper product core sandwiched between said two skins and formed of a continuous series of cells having walls extending perpendicular to said skins, said skins each having opposite outer surfaces defining a panel width, and said side edges each having a side groove formed between said skins, two vertical posts each having a top end, a bottom portion and a plurality of radially extending flanges including an interlocking flange, said flanges forming a perpendicularly shaped cross-section, said interlocking flange of one of said two posts received in each of the side grooves of the side edges of said one or more panels, the bottom portion of each of said vertical posts extending below the bottom edge of said one or more panels for anchoring in a ground surface, a top rail having a bottom surface including a top channel, said top channel having a top channel width slightly greater than said panel width, said horizontal top edge of one of said one or more panels received in said top channel for reinforcing said one or more panels, the top ends of each of said two vertical posts abutting the bottom surface of said top rail, a bottom rail having a top surface and two opposite ends, said top surface including a bottom channel, said bottom channel having a bottom channel width slightly greater than said panel width, said horizontal bottom edge of one of said one or more panels received in said bottom channel for supporting said one or more panels, each end having a notch, one of the plurality of flanges of each of said two vertical posts received in one of said notches, wherein said one or more laminar panels are interlocked between said two vertical posts and reinforced by said top and bottom rails, thereby forming a wall.

2. The modular interlocking wall system of claim 1 wherein said cementitious skins are bonded to said paper product core.

3. The modular interlocking wall system of claim 1 wherein said paper product core is treated with phenolic resins for increased resistance to moisture, fungus and pests.

4. The modular interlocking wall system of claim 1 wherein said one or more panels, said vertical posts and said top rail are coated in stucco.

5. The modular interlocking wall system of claim 1 further comprising:

said opposite ends of said bottom rail having end surfaces, and said plurality of radially extending flanges of each of said two vertical posts including one or more transverse flanges disposed perpendicularly to said locking flange, said one or more transverse flanges being in abutting relation with each of the end surfaces of said bottom rail.

6. The modular interlocking wall system of claim 1 wherein said plurality of radially extending flanges of each of said two vertical posts including one or more transverse flanges disposed perpendicularly to said locking flange, said one or more transverse flanges being in abutting relation with the cementitious skins of each of said one or more laminar panels.

7. The modular interlocking wall system of claim 1 wherein said top rail has a top surface including a longitudinally extending upwardly facing top slot.

8. The modular interlocking wall system of claim 1 wherein said flanges form an "X" shaped cross-section.

9. The modular interlocking wall system of claim 1 wherein said flanges form a "T" shaped cross-section.

10. A modular interlocking wall system comprising:

one or more laminar panels including top and bottom laminar panels, each said panel having a paper product core, two cementitious skins, horizontal top and bottom edges and two vertical side edges, said paper product core sandwiched between said two skins and formed of a continuous series of cells having walls extending perpendicular to said skins, said skins each having opposite outer surfaces defining a panel width, and said side edges each having a side groove formed between said skins, the bottom edge of said top panel having a bottom groove, the top edge of said bottom panel having a top groove, two vertical posts each having a top end, a bottom portion and a plurality of radially extending flanges including an interlocking flange, said flanges forming a perpendicularly shaped cross-section, said interlocking flange of one of said two posts received in each of the side grooves of the side edges of said one or more panels, the bottom portion of each of said vertical posts extending below the bottom edge of said one or more panels for anchoring in a ground surface, a top rail having a bottom surface including a top channel, said top channel having a top channel width slightly greater than said panel width, said horizontal top edge of one of said one or more panels received in said top channel for reinforcing said one or more panels, the top ends of each of said two vertical posts abutting the bottom surface of said top rail, a mid rail support having a plurality of radially extending flanges and two opposite ends, said plurality of flanges forming an X-shaped cross-section, one of said plurality of flanges of said mid rail support received in the bottom groove of said top panel, and one of said plurality of flanges of said mid rail support received in the top groove of said bottom panel, each of said two opposite ends having an interlocking end slot, one of the plurality of flanges of each of said two vertical posts received in each of said end slots, wherein said one or more laminar panels are interlocked between said two vertical posts and reinforced by said top and middle rails, thereby forming a wall.

11. A modular interlocking wall system comprising:

one or more laminar panels, each said panel having a paper product core, two cementitious skins, horizontal top and bottom edges and two vertical side edges, said paper product core sandwiched between said two skins and formed of a continuous series of cells having walls extending perpendicular to said skins, said skins each having opposite outer surfaces defining a panel width, and said side edges each having a side groove formed between said skins, two vertical posts each having a top end, a bottom portion and a plurality of radially extending flanges including an interlocking flange, said flanges forming an X-shaped cross-section, said interlocking flange of one of said two posts received in each of the side grooves of the side edges of said one or more panels, the bottom portion of each of said vertical posts extending below the bottom edge of said one or more panels for anchoring in a ground surface, a top rail having a bottom surface including a top channel, said top channel having a top channel width slightly greater than said panel width, said horizontal top edge of one of said one or more panels received in said top channel for reinforcing said one or more panels, the top ends of each of said two vertical posts abutting the bottom surface of said top rail, and a bottom rail having a top surface and two opposite ends, said top surface including a bottom channel, said bottom channel having a bottom channel width slightly greater than said panel width, said horizontal bottom edge of one of said one or more panels received in said bottom channel for supporting said one or more panels, each end having an interlocking notch, one of the plurality of flanges of each of said two vertical posts received in one of said notches, wherein said one or more laminar panels are interlocked between said two vertical posts, supported by said bottom rail, and reinforced by said top rail, thereby forming a wall.

12. A modular interlocking wall system comprising:

one or more laminar panels including top and bottom panels, each said panel having a paper product core, two cementitious skins, horizontal top and bottom edges and two vertical side edges, said paper product core sandwiched between said two skins and formed of a continuous series of cells having walls extending perpendicular to said skins, said skins each having opposite outer surfaces defining a panel width, said side edges each having a side groove formed between said skins, the bottom edge of said top panel having a bottom groove, and the top edge of said bottom panel having a top groove, two vertical posts each having a top end, a bottom portion and a plurality of radially extending flanges including an interlocking flange, said flanges forming an X-shaped cross-section, said interlocking flange of one of said two posts received in each of the side grooves of the side edges of said one or more panels, the bottom portion of each of said vertical posts extending below the bottom edge of said one or more panels for anchoring in a ground surface, a top rail having a bottom surface including a top channel, said top channel having a top channel width slightly greater than said panel width, the horizontal top edge of said top panel received in said top channel for reinforcing said top panel, the top ends of each of said two vertical posts abutting the bottom surface of said top rail, a mid rail support having a plurality of radially extending flanges and two opposite end portions, said plurality of flanges forming an X-shaped cross-section, one of said plurality of flanges of said mid rail support received in the bottom groove of said top panel, and one of said plurality of flanges of said mid rail support received in the top groove of said bottom panel, each of said two opposite end portions having an interlocking end slot, one of the plurality of flanges of each of said two vertical posts received in each of said end slots, and a bottom rail having a top surface and two opposite ends, said top surface including a bottom channel, said bottom channel having a bottom channel width slightly greater than said panel width, said horizontal bottom edge of said bottom panel received in said bottom channel for supporting said top and bottom panels, each of said two opposite ends having a notch, one of the plurality of flanges of each of said two vertical posts received in one of said notches, wherein said top and bottom laminar panels are interlocked between said two vertical posts, supported by said bottom and mid rails, and reinforced by said top rail, thereby forming a wall.

* * * * *